US005961033A

United States Patent [19]

Wang

[11] Patent Number: 5,961,033

[45] Date of Patent: Oct. 5, 1999

[54] PACKING BOARD FOR SUPPORTING A FOLDED-UP SHIRT IN SHAPE

[76] Inventor: Jeng-Ping Wang, 3F, No. 770-2, Hua Cheng Rd., Hsin Chuang City, Taiwan

[21] Appl. No.: 09/152,667

[22] Filed: Sep. 14, 1998

[51] Int. Cl.[6] ..... B65D 75/00

[52] U.S. Cl. ..... 229/87.17; 206/292; 206/294; 206/295; 206/296

[58] Field of Search ..... 229/87.17; 206/296, 206/297, 278, 294, 295, 195, 292; 223/71

[56] References Cited

U.S. PATENT DOCUMENTS

| | | | |
|---|---|---|---|
| 1,115,169 | 10/1914 | Cahn | 233/71 |
| 1,132,841 | 3/1915 | Gilderson | 299/71 |
| 1,187,014 | 6/1916 | Simon | 233/71 |
| 1,196,943 | 9/1916 | Gilkerson | 233/71 X |
| 1,317,241 | 9/1919 | Tharp | 233/71 X |
| 2,204,419 | 6/1940 | Lighter | 229/87.17 |
| 2,236,577 | 4/1941 | Morse | 229/87.17 |
| 2,487,761 | 11/1949 | McFall et al. | 229/87.17 |
| 4,240,553 | 12/1980 | Leopold | 229/296 |

*Primary Examiner*—Gary E. Elkins
*Assistant Examiner*—Tri M. Mai
*Attorney, Agent, or Firm*—Bacon & Thomas, PLLC

[57] ABSTRACT

A packing board for supporting and securing a folded-up shirt in shape, having two side panels symmetrically extended from two opposite lateral sides of a base panel thereof for holding down a folded-up shirt on the base panel, each side panel having a plug flap and a retainer flap respectively disposed at a front side and a suspended holding down flap adjacent to the retainer flap.

3 Claims, 5 Drawing Sheets

PACKING BOARD FOR SUPPORTING A FOLDED-UP SHIRT IN SHAPE

BACKGROUND OF THE INVENTION

The present invention relates to packing materials, and more specifically to a packing board for supporting and securing a folded-up shirt in shape.

When a shirt is made, it is smoothened with an iron, then folded up and packed on a packing board, and then pins are sued to secure the shirt and the packing board together, and then the packed shirt is put in a packing bag and well packed for sale. Because the packing board is simply a rectangular cardboard, it needs certain techniques to well pack the shirt on the packing board. It is not a good way to secure the shirt to the packing board with pins, because the pins make pin holes on the shirt, and the shirt will be contaminated if the pins are rusted. Further, when removing the pins from the shirt and the packing board, the fingers tend to be injured by the pointed tips of the pins.

SUMMARY OF THE INVENTION

The present invention has been accomplished to provide a packing board which eliminates the aforesaid drawbacks. According to the present invention, the packing board comprises a base panel having a collar flap at its front side, and two side panels symmetrically extended from two opposite lateral sides of the base panel for holding down a folded-up shirt on the base panel, each side panel having a plug flap and a retainer flap respectively disposed at a front side and a suspended holding down flap adjacent to the retainer flap. When the shirt is supported on the base panel with its collar supported on the collar flap of the base panel and secured in place by the holding down flaps of the side panels, the sleeves of the shirt are folded up and attached to the back side of the packing board, then the side panels are respectively turned inwards and covered on the base panel one over the other, permitting the retainer flaps of the side panels to be fastened together, and then the lower part of the shirt is folded up and closely attached to the side panels at the back side of the base panel and secured in place by the plug flaps of the side panels.

DETAILED DESCRIPTION OF THE PREFERRED EMBODIMENT

Figure 1:
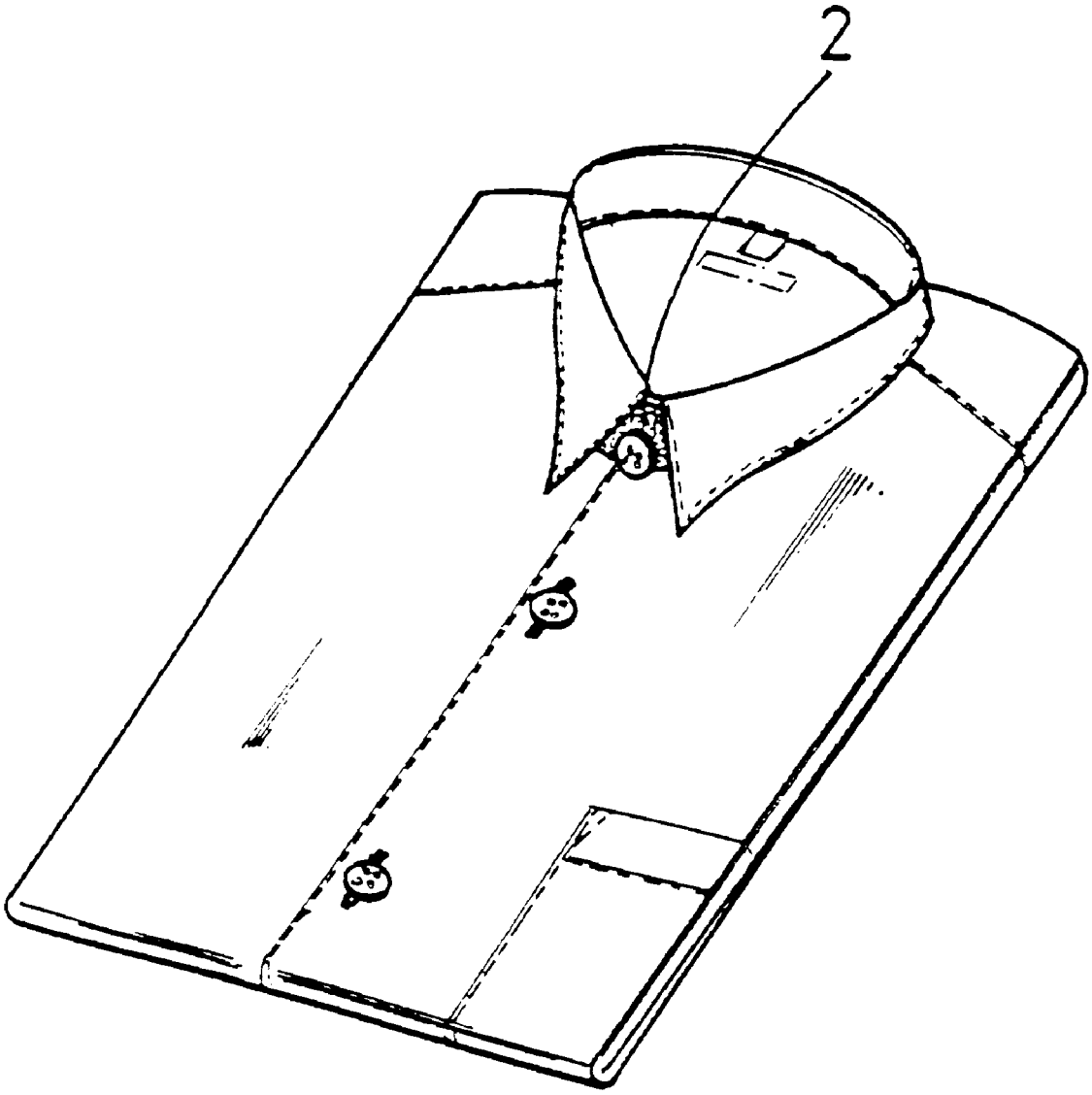
FIG. 1 is a plain view of a packing board according to the present invention.

Referring to FIG. 1, a packing board 1 is adapted to support a folded-up shirt in shape in accordance with the present invention is made by stamping a sheet material, for example, a cardboard into shape, comprising a base panel 11, a first side panel 12 and a second side panel 13 symmetrically extended from two opposite lateral sides of the base panel 11. The outer sides (opposite to the inner sides that are connected to the two opposite lateral sides of the base panel 11) of the first side panel 12 and second side panel 13 are respectively made curved. The base panel 11 has a collar flap 110 extended from its front side on the middle, and an arched cut 10 on the middle adjacent to the collar flap 110. The side panel 12 or 13 comprises a plug flap 123 or 133 extended from its front side adjacent to the base panel 11 and folded up into two folds, a retainer flap 122 or 132 extended from its front side in one corner remote from the base panel 1, and two oblique holding down flaps 121 or 131 formed by stamping and disposed adjacent to the plug flap 123 or 133 and the retainer flap 122 or 132. The oblique holding down flaps 121 or 131 each have one side connected to the side panel 12 or 13, and an opposite side cut from the side panel 12 or 13. When each oblique holding down flap 121 or 131 is made, a corresponding opening is formed in the side panel 12 or 13.

Figure 2:
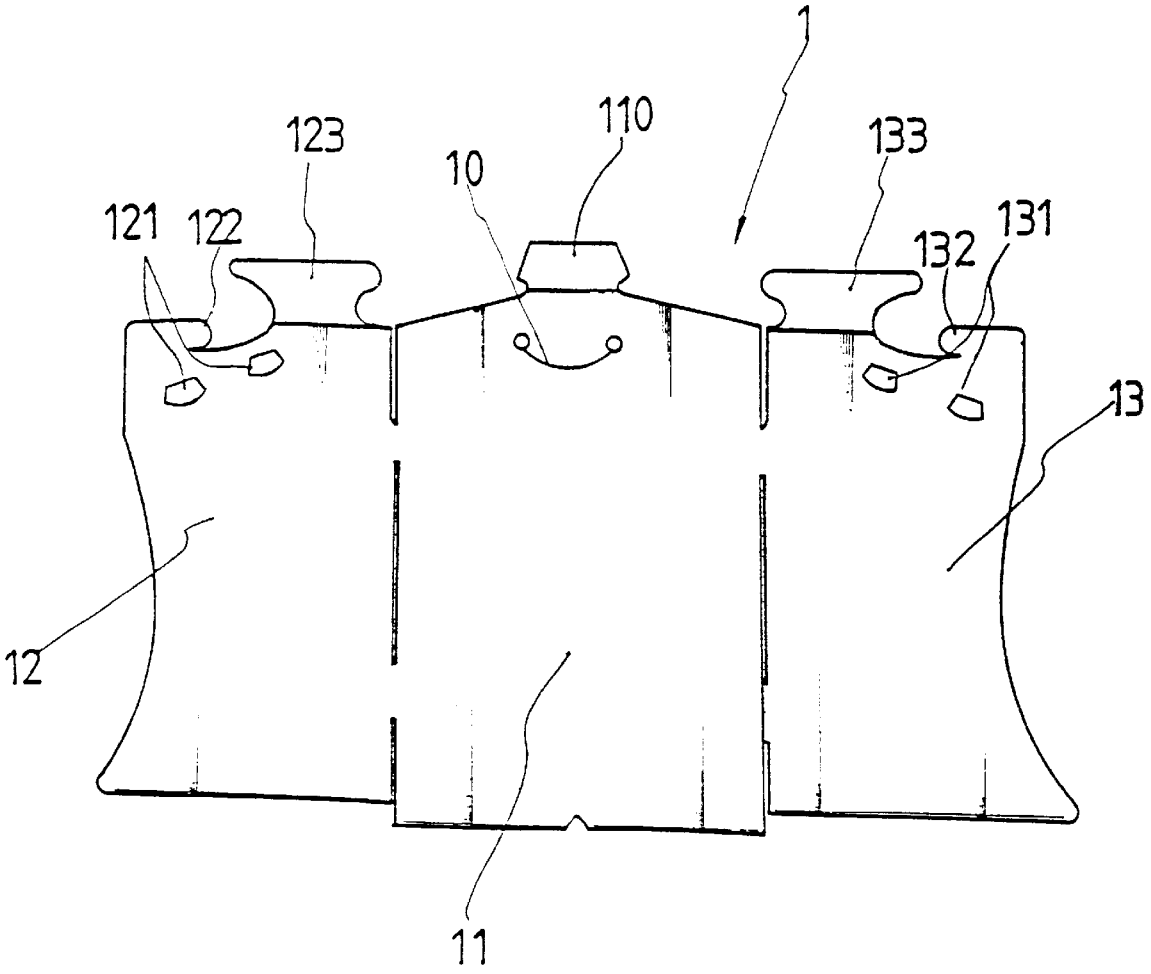
FIG. 2 is a schematic drawing showing the application of the present invention (the sleeves of the shirt folded up and attached to the back side of the packing board).
Figure 3:
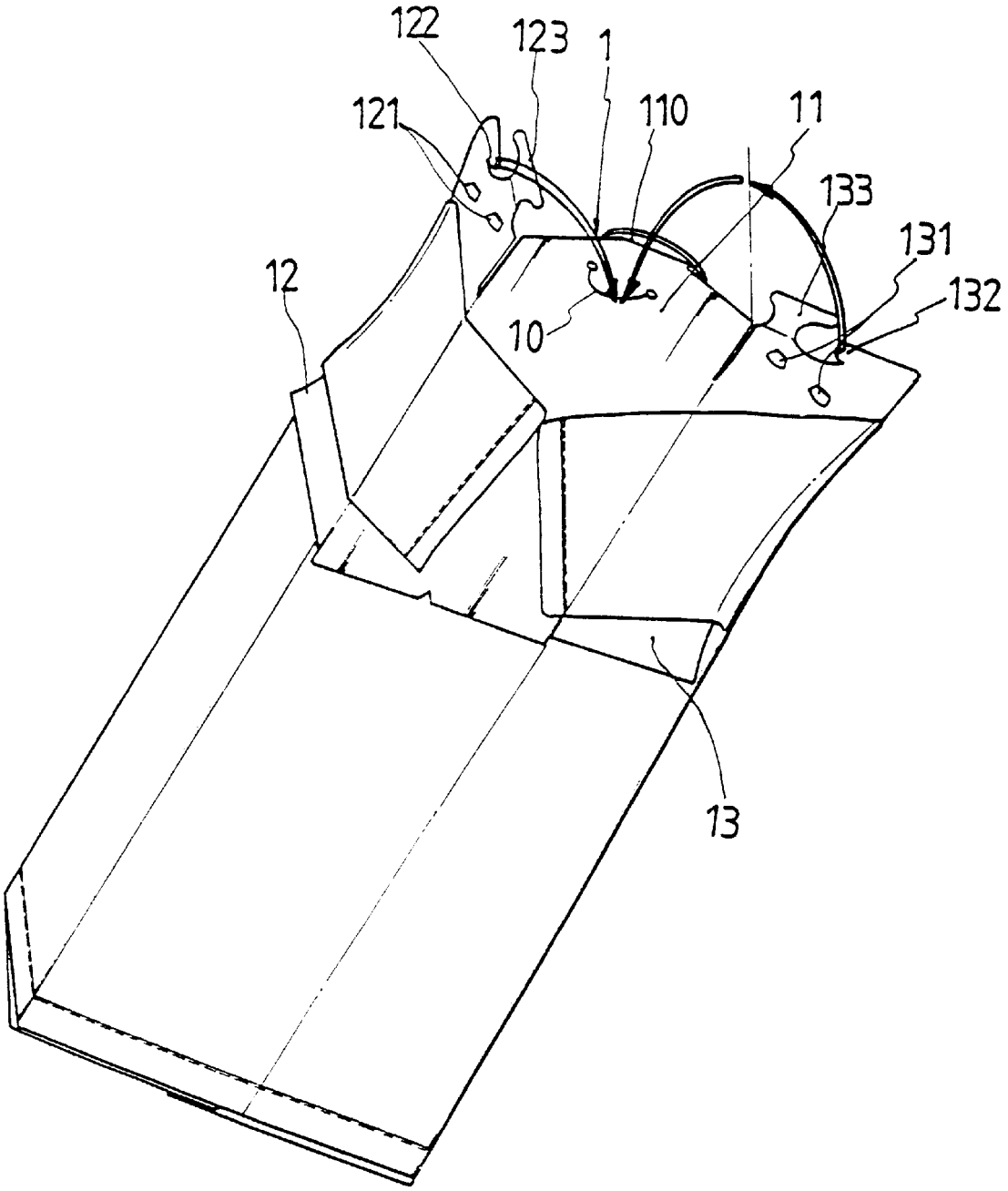
FIG. 3 is a schematic drawing showing the application of the present invention (the side panels with the sleeves of the shirt folded up and attached to the back side of the base panel, and the lower part of the shirt folded up).
Figure 4:
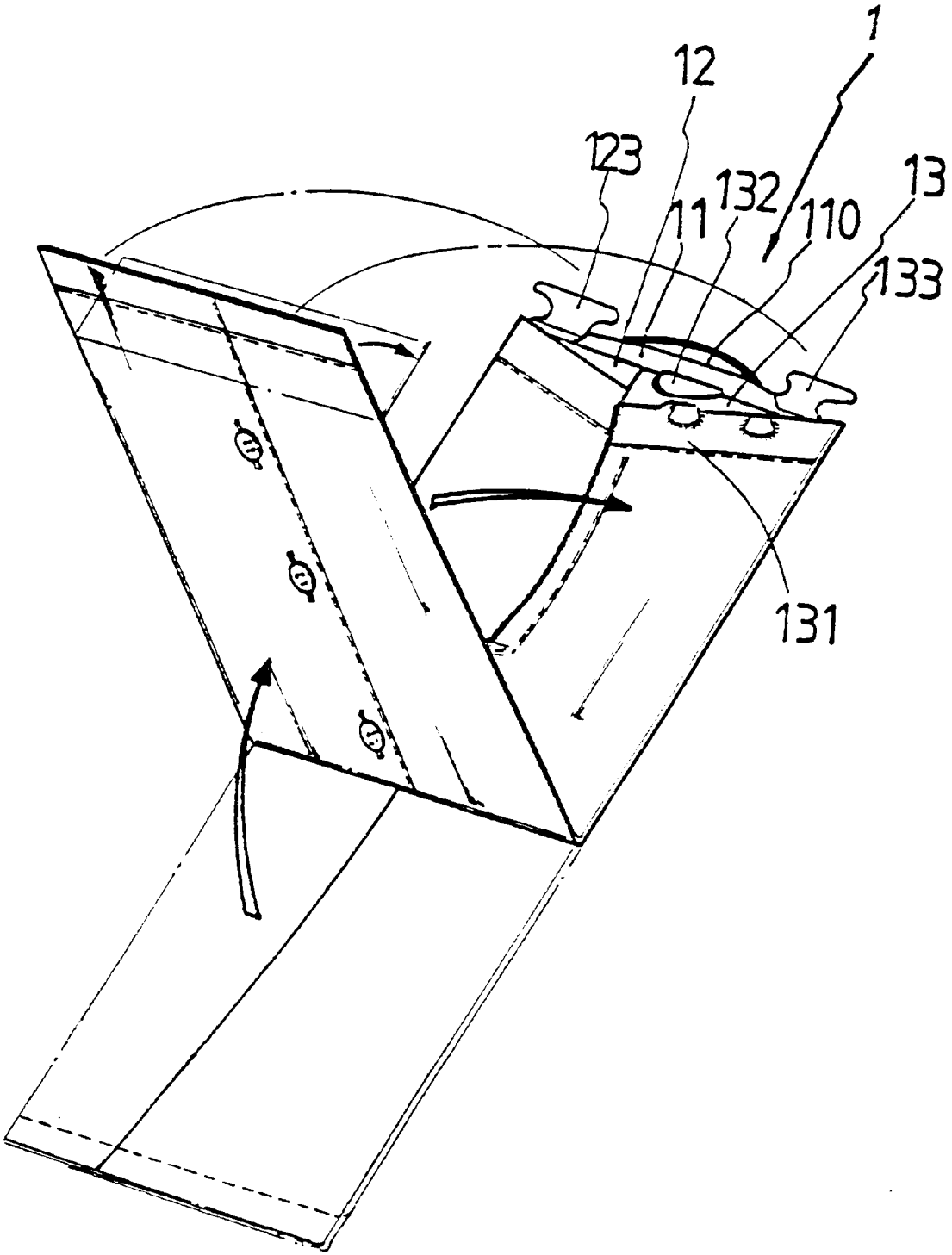
FIG. 4 is a perspective view showing the shirt packed on the packing board.
Figure 5:
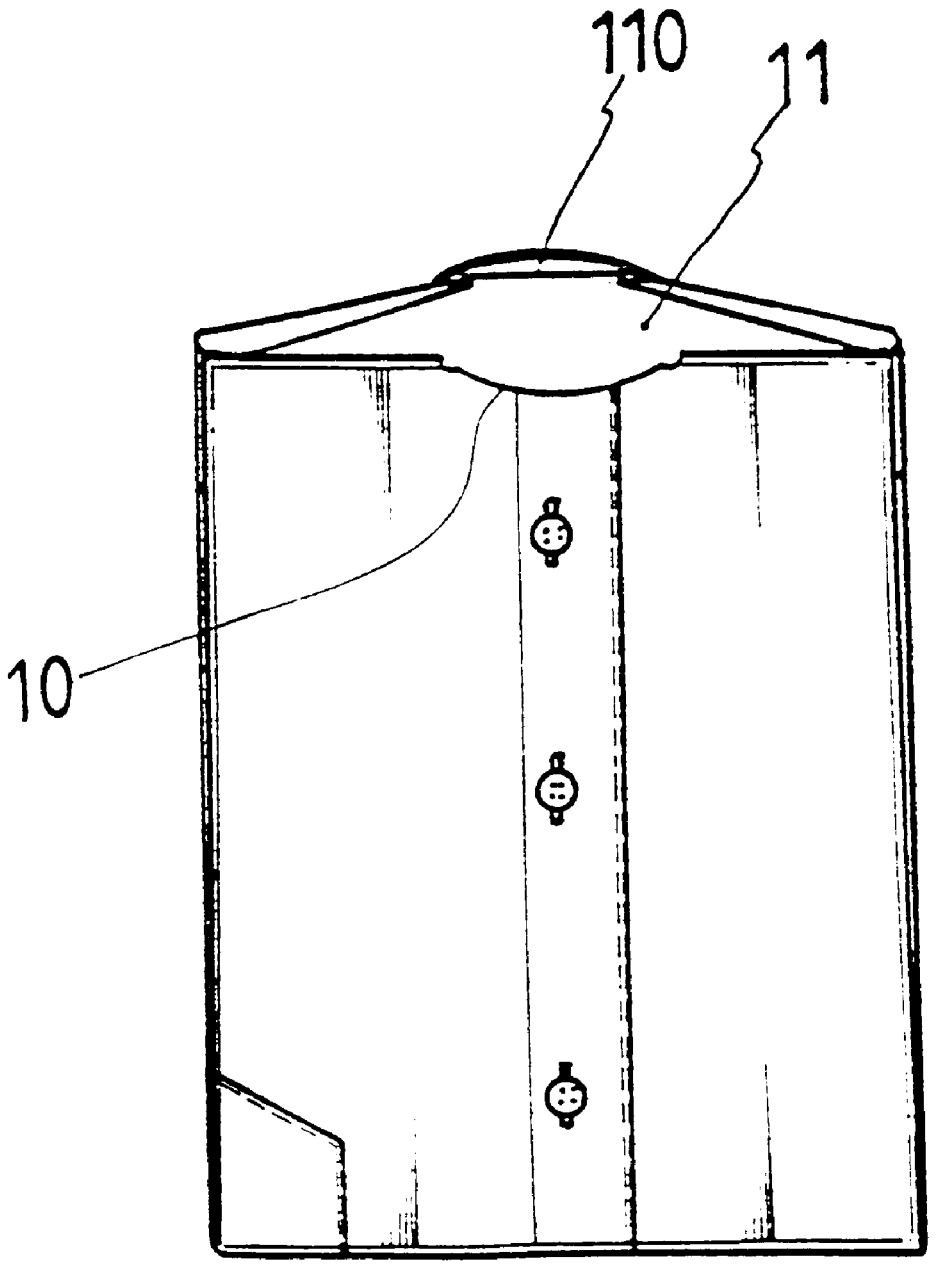
FIG. 5 is a back side view of FIG. 4.

Referring to FIGS. 2, 3 and 4, the collar flap 110 of the base panel 11 is inserted into the gap at the back side of the collar of the shirt, permitting the back panel of the shirt to be supported on the base panel 11, then the sleeves of the shirt are respectively turned backwards over the curved outer sides of the side panels 12,13 and respectively covered over the back sides of the side panels 12,13 and base panel 11 and secured in place by the oblique holding down flaps 121, 131, and then the side panels 12,13 are respectively turned inwards and covered on the base panel 11 one over the other, permitting the retainer flaps 122,132 of the side panels 12,13 to be fastened together and engaged into the arched cut 10 at the base panel 11 (see FIG. 3), and then the lower part of the shirt is folded up and closely attached to the side panels 12,13 at the back side of the base panel 11, and then the plug flaps 123,133 are respectively inserted into the folded up shirt from two sides, and therefore the shirt is secured to the packing board in shape (see FIGS. 4 and 5).

What the invention claimed is:

1. A packing board for supporting and securing a folded-up shirt in shape, comprising a base panel having a collar flap extended from a front side thereof, wherein said base panel has an arched cut adjacent to said collar flap; two symmetrical side panels are respectively extended from two opposite lateral sides of said base panel, said side panels each comprising a front side, an inner lateral side connected to said base panel, an outer lateral side opposite to said inner lateral side, a plug flap extended from the respective front side adjacent to said base panel and adapted to be inserted in a gap in the folded up shirt to secure the shirt in place, a retainer flap extended from the respective front side in one corner remote from said base panel adapted to be respectively fastened to said arched cut at said base panel to secure the shirt in place, and two suspended oblique holding down flap disposed adjacent to said retainer flap and adapted to secure the sleeves of the shirt in place.

2. The packing board of claim 1, wherein said suspended oblique holding down flap is made from the respective side panel by stamping, having one side connected to the respective side panel.

3. The packing board of claim 1, wherein the outer lateral side of each of said side panels has a curved edge.

* * * * *